US005277415A

United States Patent [19]

Kinoshita et al.

[11] Patent Number: 5,277,415

[45] Date of Patent: Jan. 11, 1994

[54] SHEET FEEDING DEVICE

[75] Inventors: Naohisa Kinoshita; Mitsuyoshi Uehara; Eiji Tanaka, all of Nagoya, Japan

[73] Assignee: Brother Kogyo Kabushiki Kaisha, Nagoya, Japan

[21] Appl. No.: 947,470

[22] Filed: Sep. 21, 1992

[30] Foreign Application Priority Data

Oct. 31, 1991 [JP] Japan ..... 3-286596

[51] Int. Cl.[5] ..... B65H 9/04

[52] U.S. Cl. ..... 271/110; 271/242; 271/265; 271/188

[58] Field of Search ..... 271/110, 111, 227, 242, 271/265, 161, 188

[56] References Cited

U.S. PATENT DOCUMENTS 4,337,935 7/1982 Sawada et al. .
4,361,399 11/1982 Sawada et al. ..... 271/242
4,871,160 10/1989 Yoshino ..... 271/110
5,056,771 10/1991 Beck et al. ..... 271/265
5,104,110 4/1992 Haibara ..... 271/265

FOREIGN PATENT DOCUMENTS 1056144 12/1980 Japan ..... 271/110
0197332 9/1986 Japan ..... 271/110
0176248 7/1988 Japan ..... 271/111

*Primary Examiner*—H. Grant Skaggs
*Attorney, Agent, or Firm*—Oliff & Berridge

[57] ABSTRACT

A sheet feeding device used for an image forming device which has a print part, such as the laser printer. A control part drives a separation roller installed under the print part and the paper supplying roller and supplies the printing paper to a resist roller individually. When a predetermined time passes afterwards, the control part drives the resist roller and transports the printing paper to the print part. In this case, a curve part enables miniaturization of the entire device as a result of being installed in a vertical part of the sheet guide.

20 Claims, 6 Drawing Sheets

Fig.4B

| ITEM | INSTRUCTIONS |
|---|---|
| S1 | CONNECT FIRST ELECTROMAGNETIC CLUTCH |
| S2 | START COUNTING A TIME |
| S3 | HAS FIRST TIME COUNTED ? |
| S4 | SEPARATE FIRST ELECTROMAGNETIC CLUTCH |
| S5 | STOP COUNTING A TIME |
| S6 | HAS CPU RECEIVED AN OUTPUT SIGNAL ? |
| S7 | START COUNTING A TIME |
| S8 | HAS SECOND TIME COUNTED ? |
| S9 | CONNECT SECOND ELECTROMAGNETIC CLUTCH |
| S10 | HAS THIRD TIME COUNTED ? |
| S11 | SEPARATE SECOND ELECTROMAGNETIC CLUTCH |

SHEET FEEDING DEVICE

BACKGROUND OF THE INVENTION

1. Field of the Invention

The present invention relates to a sheet feeding device to transport a sheet to the print part in preparation for image forming devices such as the printer and the copier.

2. Description of Related Art

There exists laser printer 100 (for example, Trade Name : HL-8, made by Brother Industries, LTD.) which has a space 139 in a horizontal part of a sheet feeding path. The space 139 is provided because the inclination and the position of sheet 113 are corrected before sheet 113 is transported to the print part. FIG. 5 shows a part of the construction of the laser printer 100. In this laser printer 100, a plurality of sheets 113 are accumulated and stored in a sheet cassette 115. An uppermost positioned sheet 113 is separated from the accumulated sheets 113 in the sheet cassette 115 by rotation of a separation paper roller 117, and is fed to a pair of feeding rollers 141 through sheet guide 137. As the sheet 113, which bumps against stopped feeding rollers 141, is further fed to the direction of the feeding rollers 141, the sheet 113 bends in the space 139 mentioned above. Accordingly, pressure is added to the sheet 113 in the direction of arrow P shown in FIG. 5, and the inclination and the position of sheet 113 are corrected. Then, the feeding rollers 141 start to rotate, and the sheet 113 having corrected inclination and position is fed to the print part (not shown).

However, this laser printer 100 entails a problem such that the whole device is enlarged because the sheet cassette 115 projects out of the laser printer 100. Then, to solve the above-mentioned problem, laser printer 200 shown in FIG. 6 (for example, Trade Name : HL-4, made by Brother Industries, LTD.) was contrived. In this, laser printer 200, sheet cassette 215 is provided under a print part 221, an uppermost positioned sheet 213 is separated from the accumulated sheets 213 in the sheet cassette 215 by rotation of a separation paper roller 217, and the separated sheet is fed to a pair of feeding rollers 241 through sheet guide 237. As the sheet 213 which bumps against stopped feeding rollers 241 is further fed to the direction of the feeding rollers 241, the sheet 213 bends in the space 239 provided in a horizontal part of the sheet guide 237. Accordingly, pressure is added to the sheet 213 in the direction of the feeding rollers 241, and the inclination and the position of sheet 213 are corrected. Then, the feeding rollers 241 start to rotate, and the sheet 213 having the corrected inclination and position is fed to the print part 221. According to the construction mentioned above, the laser printer 200 is more miniaturized than the laser printer 100.

SUMMARY OF THE INVENTION

However, even this laser printer 200 entails a problem described below. That is, as the space 239 is provided in the horizontal part of sheet guide 237, only a small toner cartridge which can store a small amount of toner particles is provided. Further, the whole device cannot be miniaturized to a greater degree even though the sheet cassette 215 is provided under the print part 221.

An object of the present invention is to solve the problems mentioned above by providing the sheet feeding device which is able to miniaturize the printer main body and transport the sheet to the print part accurately.

The sheet feeding device of the present invention overcomes the above-mentioned problems by including a sheet supplying means provided substantially beneath a print means. A feeding means feeds the sheet supplied by the sheet supplying means to the print means. A guide means cooperates with the sheet supplying means to guide the sheet to the feeding means. A buffer means stores a bent part of the sheet, the buffer means being provided in a substantially vertical portion of the guide means. A control means drives the feeding means when a predetermined time has passed following driving of the sheet supplying means and bumps the sheet against the feeding means.

First, the control means drives the sheet supplying means installed under the print means and supplies the printing paper to the feeding means individually according to the present invention which has the above-mentioned construction. At this time, the sheet inclination and position are corrected after the sheet is bumped against the feeding means When a predetermined time passes afterwards, the control means drives the feeding means and transports the printing paper to the print means. In this case, a buffer means installed in a short vertical part of the guide means can further miniaturize the entire device.

BRIEF DESCRIPTION OF THE DRAWINGS

A preferred embodiment of the present invention will be described in detail with reference to the following figures, wherein:

FIGS. 4A and 4B are a flowchart and a flowchart explanation, respectively, which show the paper supplying process of the laser printer which has the sheet feeding device of the present invention;

DETAILED DESCRIPTION OF THE PREFERRED EMBODIMENT

Figure 1:
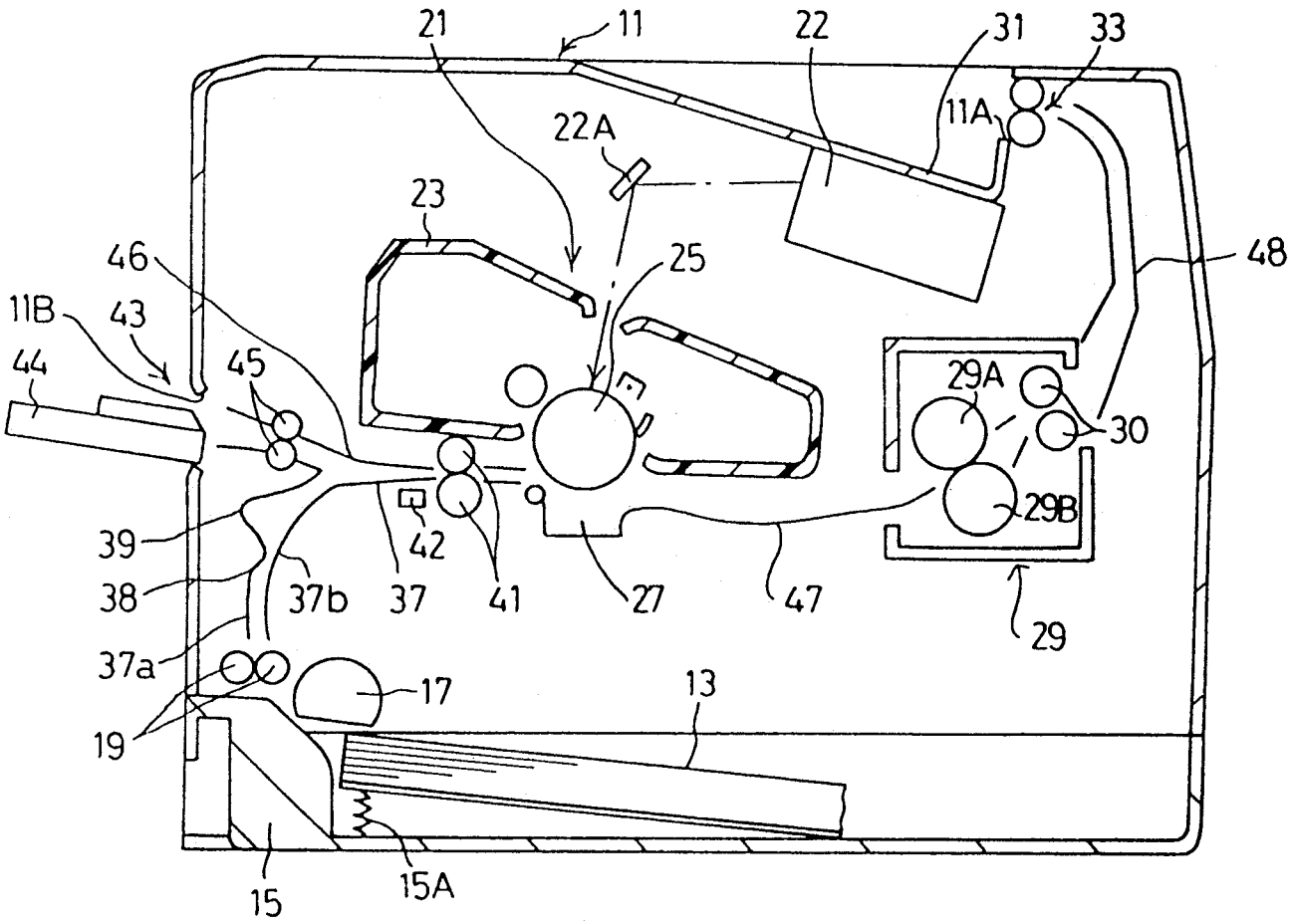
FIG. 1 is a cross-sectional view which shows the construction of the laser printer which has the sheet feeding device of the present invention.

Hereafter, one embodiment of the present invention is described by referring to the drawings.

Figure 2:
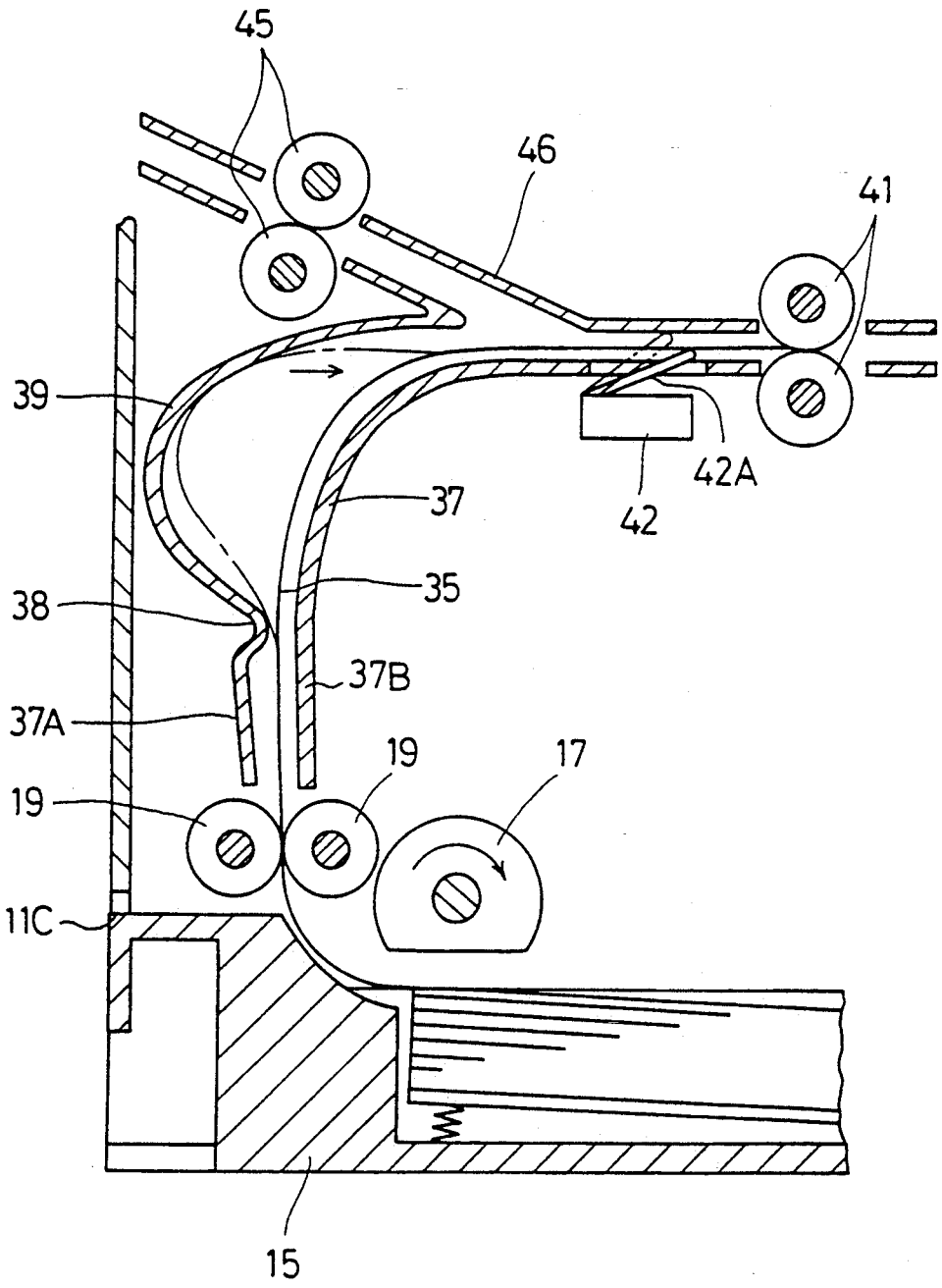
FIG. 2 is an expanded sectional view which shows the sheet feeding device of the present invention.

First, the construction of the laser printer which has the sheet feeding device of this embodiment is described by referring to FIGS. 1–2. The resin exterior of this laser printer 11 is preferably formed by injection molding. The sheet outlet 11A and discharging tray 31 are installed in an uppermost part of this device exterior. A printed discharged sheet 3 is accumulated on the discharging tray 31. Moreover, a manual insertion paper supplying entrance 11B and a manual insertion tray 44 which are a part of manual insertion paper supplying mechanism 43 are installed in the substantially central portion of the left side of the device exterior. The manual insertion paper put on manual insertion tray 44 is supplied in the laser printer 11 from the manual insertion paper supplying entrance 11B by feeding roller 45 described hereinbelow. The paper supplying entrance 11C (FIG. 2) is installed under the left side of the device exterior, and a sheet cassette 15 described hereinbelow can be detachably installed in the laser printer 11 main body from the paper supplying entrance 11C.

The interior of the laser printer 11 is provided with respect to the paper supplying part, sheet feeding part, a part of manual insertion paper supplying mechanism 43, print part 21, thermal fixing part 29 and sheet discharging part. The paper supplying part is installed under the device interior and is constructed from sheet cassette 15 which functions as a sheet supplying means or storage means. Separation roller 17 functions as a sheet supplying means or a paper supplying means. The resin sheet cassette 15 is formed by injection molding and is detachably installed in laser printer 11 main body through the paper supplying entrance 11C of laser printer 11 as mentioned above. Moreover, it is possible to store a plurality of sheets being accumulated in this sheet cassette 15. When sheet cassette 15 is installed in the laser printer 11 through the paper supplying entrance 11C, accumulated sheets 13 are lifted by the spring 15A in the upper direction. The separation roller 17 is rotatably arranged in a front upper side of the sheet cassette 15 installed through the paper supplying entrance 11C. The separation roller 17 is made of rubber and has a D character sectional shape. When the sheet cassette 15 is installed in the laser printer 11 and the accumulated sheets 13 are lifted by the spring 15A in the upper direction as mentioned above, the peripheral surface of the separation roller 17 comes in contact with an uppermost sheet 13 in the sheet cassette 15. However, a flat surface of the separation roller 17 does not come in contact with the uppermost sheet 13. The separation roller 17 cooperates with a separation member (not shown) for separating an uppermost sheet 13 from other accumulated sheets 13 and feeding the uppermost sheet 13 away from the sheet cassette 15. Furthermore, the separation roller 17 is connected to motor 63 through first electromagnetic clutch 65 described later. The rotational power of motor 63 can be transmitted to the separation roller 17 in accordance with the connection of first electromagnetic clutch 65. If there is no connection, the rotational power of motor 63 is not transmitted to separation roller 17.

The sheet feeding part is installed substantially at the center of the left side of the device interior. The sheet feeding part is constructed from a pair of paper supplying rollers 19 which function as a sheet supplying means or a paper supplying means, a pair of sheet guides 37 which function as a guide means, a pair of resist rollers 41 which function as a feeding means and a sensor 42 which functions as a detection means. Paper supplying rollers 19 are rotatably arranged to the left of the separation roller 17, and feed a sheet 13 which has been separated from the paper supplying part to sheet guide 37. Moreover, the paper supplying rollers 19 are made of rubber and are driven by motor 63 described hereinbelow. The pair of sheet guides 37 are made of resin, and are constructed from the left side sheet guide 37A and the right side sheet guide 37B. The sheet guides 37A, 37B are vertically constructed near the paper supplying rollers 19. Curve portion 39 which functions as a buffer means and projection portion 38 are formed in the substantially central portion of the sheet guide 37A. Projection portion 38 projects toward the right side sheet guide 37B, and narrows the width of paper feeding path 35. As projection portion 38 narrows paper feeding path 35 near the paper supplying rollers 19, bending of the sheet 13 is not caused near the paper supplying rollers 19. Curve portion 39 projects largely toward a direction away from the right side sheet guide 37B, and enlarges the width of paper feeding path 35. A part of bent sheet 13 described hereinbelow is stored in the curve portion 39. The top of the left sheet guide 37A adjoins manual insertion paper supplying mechanism 43. A pair of sheet guides 37 form paper feeding path 35 to guide a sheet 13 which has been sent by paper supplying rollers 19 to the space (as it is called from now on in the transferring position) between transferring roller 25 and transferring portion 27 described later.

A pair of resist rollers 41 is rotatably provided downstream of sheet guides 37, that is, near the print part 21 described hereinbelow. The resist rollers 41 adjust the timing when the sheet 13 goes into the transferring position for transfer of a toner image on a predetermined position of sheet 13 and feed the sheet 13 toward the transferring position. The resist rollers 41 are connected to motor 63 through second electromagnetic clutch 67 described hereinbelow, the rotational power of motor 63 being transmitted to the resist rollers 41 in accordance with the connection of second electromagnetic clutch 67, respectively. If the resist rollers 41 are not connected to the second electromagnetic clutch 67, the rotational power of motor 63 is not transmitted to the resist rollers 41.

Sensor 42 is provided upstream of the resist rollers 41. The sensor 42 detects the arrival of a front edge of sheet 13 just prior to the resist rollers 41. This sensor 42 has an actuator 42A which projects in paper feeding path 35. The actuator 42A is normally arranged in the first position shown by one point chain line in FIG. 2. When the front edge of the sheet 13 is fed to the resist rollers 41, the actuator 42A is moved to a second position shown by solid line in FIG. 2 by the front edge of the sheet 13. When the actuator 42A is moved from the first position to the second position, sensor 42 outputs a signal to CPU 51 which shows that the front edge of the sheet 13 is located just ahead of the resist rollers 41.

Manual insertion paper supplying mechanism 43 is constructed from the manual insertion paper supplying entrance 11B, the manual insertion tray 44, a pair of the paper supplying rollers 45, an upper part of the sheet guide 37A, an upper part of the sheet guide 37B and the sheet guide 46. The manual insertion paper supplying entrance IIB is provided at the substantially center of the left side of the device exterior mentioned above. The manual insertion paper supplying tray 44 made of resin is arranged at the manual insertion paper supplying entrance 11B. The paper supplying rollers 45 are made of rubber and are driven by motor 63 as described hereinbelow. The sheet guide 46 guides the manual insertion paper to the resist rollers 41 by cooperating with the upper part of the sheet guide 37A and the upper part of the sheet guide 37B. The manual insertion paper placed on the manual insertion tray 44 is supplied from the manual insertion paper supplying entrance IIB into laser printer 11 by paper supplying rollers 45, and is guided by the sheet guides 37A, 37B and 46, and is fed to the resist rollers 41.

Print part 21 which functions as a print means is provided at the substantially center of the laser printer 11 and above sheet cassette 15. This print part 21 is constructed similarly to the print part of the well-known laser printer and is constructed from laser unit 22, toner cartridge 23, transferring roller 25 and transferring portion 27. The laser unit 22 is fixedly provided on a side of the discharging tray 31, and emits a laser beam in accordance with image data input from an external device described hereinbelow. The laser beam emitted from the laser unit 22 is reflected by a reflector 22A and irradiates the transferring roller 25 to form a latent image corresponding to the image data. Toner cartridge 23 supports the transferring roller 25 rotatably and has a toner tank storing the toner particles and a toner particle supply portion supplying the toner particles to the transferring roller 25. In this embodiment, as the space is not provided in the sheet guide's horizontal part, toner particle cartridge 23 can be designed in a large shape and thus can store a large amount of the toner particles. Moreover, an aperture is provided at substantially a central upper part of the toner cartridge 23 so that the laser beam emitted from the laser unit 22 can irradiate the transferring roller 25 through the aperture. The laser beam forms the latent image corresponding to the image data on the transferring roller 25 to form the toner image on the transferring roller 25 as mentioned above. The transferring roller 25 is a well-known photosensitive drum, the transferring roller 25 being rotatably arranged in the toner cartridge 23 as mentioned above. A part of the peripheral surface of the transferring roller 25 is exposed through an aperture provided under a part of the toner cartridge 23, and confronts the transferring portion 27. Transferring portion 27 confronts the transferring roller 25 by a predetermined interval, and transfers a toner image formed on the transferring roller 25 on the sheet 13 supplied from either the sheet cassette 15 or the manual insertion paper supplying mechanism 43.

Thermal fixing part 29 comprises heat roller 29A and pressure roller 29B. The heat roller 29A is made of aluminum and has a heat source (not shown) therein. The pressure roller 29B is made of silicon rubber and contacts the heat roller 29A with pressure. Further, the thermal fixing part 29 is provided at the right of print part 21. Moreover, a pair of paper supplying rollers 30 made of the resin and rubber are also provided in thermal fixing part 29. The sheet 13 to which the toner image is transferred at the print part 21 is guided by sheet guide 47 and is fed to thermal fixing part 29. The heat roller 29A and pressure roller 29B are rotatably arranged in the thermal fixing part 29, and both rollers 29A, 29B fix the toner image on the sheet 13.

The sheet discharging part is constructed from the sheet outlet 11A, a pair of discharging rollers 33 and a pair of sheet guides 48 and is arranged substantially above thermal fixing part 29. The sheet 13 sent from thermal fixing part 29 is further fed to the discharging rollers 33 through sheet guides 48. The discharging rollers 33 are rotatably provided at the sheet outlet 11A and discharge a sheet 13 on which the toner image is formed onto the discharging tray 31 installed on the laser printer 11.

Figure 3:
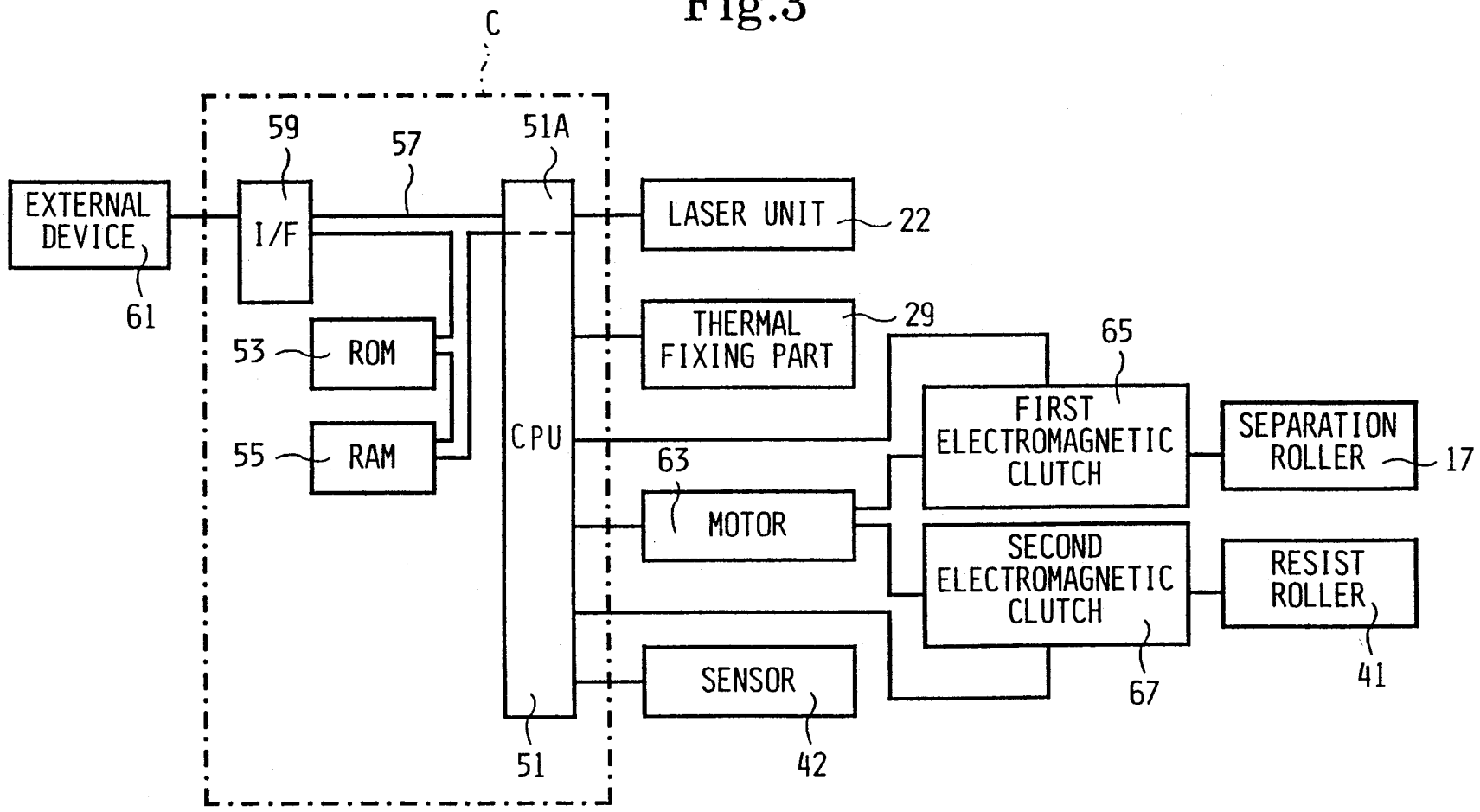
FIG. 3 is a block diagram which shows the electric construction of the laser printer which has the sheet feeding device of the present invention.

Next, the electric construction of laser printer 11 is explained by referring to FIG. 3.

The Control part C which functions as a control means controls the laser printer 11 and comprises a well-known microcomputer which has CPU 51, ROM 53 and RAM 55. ROM53 and RAM55 are connected to CPU 51 by bus 57. Moreover, external device 61 such as a host computer is connected to CPU 51 through interface 59 connected to bus 57. This external device 61 outputs the image data which consists of a character code and a control code. In addition, the CPU 51 has a timer 51A which functions as a time count means.

Figure 4A:
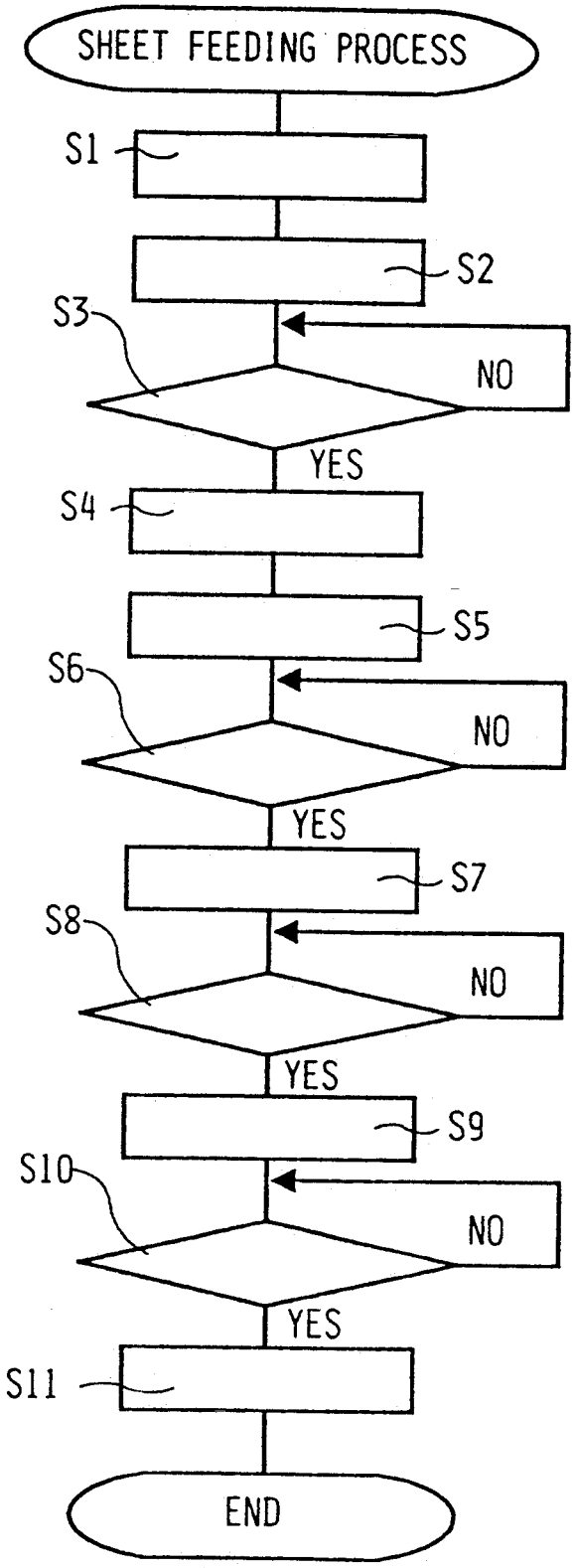
Figure 5:
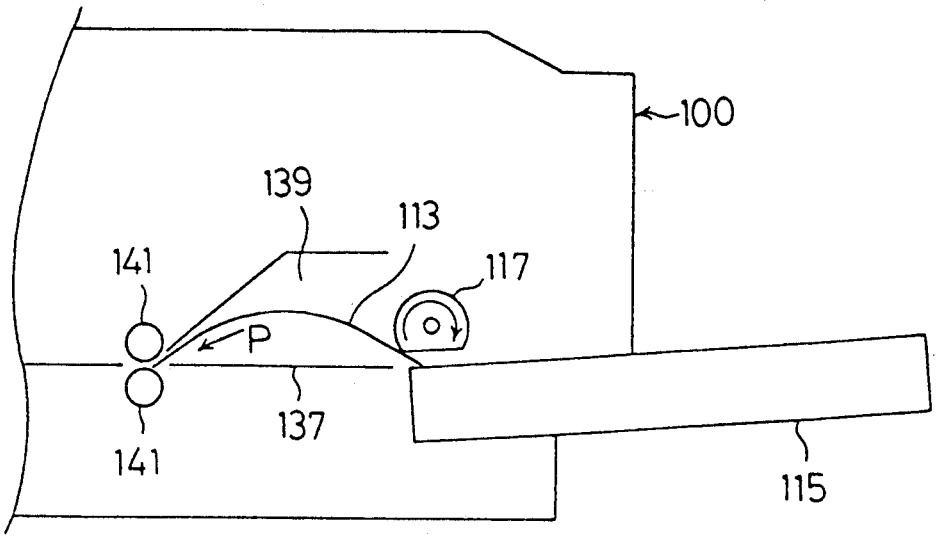
Fig.5 RELATED ART
FIG. 5 is a cross-sectional view which shows a part of a conventional laser printer.
Figure 6:
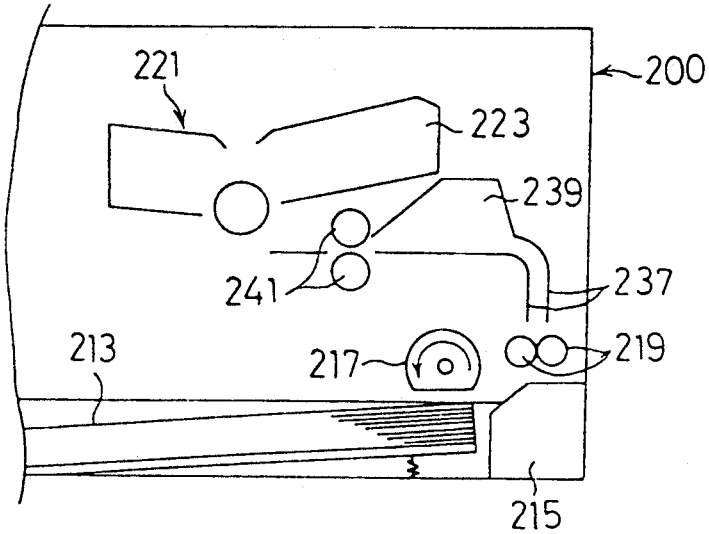
Fig.6 RELATED ART
FIG. 6 is a cross-sectional view which shows a part of another conventional laser printer.

Various programs such as a program for printing the image based on the image data on sheet 13 by print part 21, a program for supplying a sheet 13 shown by a flowchart in FIG. 4, and various data such as data to make the character pattern of the character code, are stored in ROM 53. Moreover, a first time, second time and third time are stored in ROM 53. The first time is time taken for one rotation of separation roller 17 after the first electromagnetic clutch 65 is connected. The second time is the time interval between detection of the front edge of sheet 13 by sensor 42 to the connection of the second electromagnetic clutch 67. The third time is the time interval between detection of the front edge of sheet 13 by sensor 42 to the disassociation of the second electromagnetic clutch 67.

On the other hand, RAM 55 has various buffer areas such as the page buffer which stores the dot data of one page based on the image data and the reception buffer which temporarily stores the image data output from external device 61.

The laser unit 22, the thermal fixing part 29, the motor 63, the first electromagnetic clutch 65, the second electromagnetic clutch 67 and sensor 42 are connected to the control part C. The control part C controls the laser beam to be emitted by laser unit 22 based on the image data input from external device 61. Moreover, the control part C controls the heat source in the heat roller 29A so that the temperature of the heat roller 29A of thermal fixing part 29 may be maintained constant. Further, the control part C controls the motor 63, and controls the connection or disassociation of the first electromagnetic clutch 65 and the second electromagnetic clutch 67 based on the output signal from the sensor 42 and the first, the second and the third times stored in ROM 53. Next, the paper supplying movement of laser printer 11 is explained by referring to FIG. 4.

When the image data is input from external device 61 through interface 59, this image data is stored in RAM 55. Next, the control part C memorizes the dot data of one page in the page buffer of RAM55 based on the stored image data. Control part C executes the flowchart shown in FIG. 4.

First, CPU 51 makes the first electromagnetic clutch 65 connection, and the first electromagnetic clutch 65 transmits the rotational power from the motor 63 to the separation roller 17 in Step 1. (Hereafter, all steps are referred to with the prefix "S".) Next, CPU 51 makes timer 51A built in CPU 51 start to count a time (S2). Then, the separation roller 17 is rotated in the direction of the arrow shown in FIG. 2 by the motor 63. The uppermost sheet 13 accumulated in the sheet cassette 15 is separated by the rotation of the separation roller 17, and the separated sheet 13 is sent out of the sheet cassette 15. Moreover, the paper supplying rollers 19 are driven by the motor 63 and are rotated at the same time.

Next, CPU 51 reads out the first time stored in ROM 53, and judges whether the timer 51A has counted the first time or not (S3). When CPU 51 determines that the timer 51A has not counted the first time (S3:No), CPU 51 repeats the S3. When CPU 51 determines that the timer 51A has counted the first time (S3:Yes), CPU 51 makes the first electromagnetic clutch 65 separate, and the rotational power of the motor 63 is not transmitted to the separation roller 17 (S4). The separation roller 17 is stopped after one rotation when the transmission of the rotational power of the motor 63 is intercepted. Moreover, CPU 51 stops and initializes the timer 51A (S5). The sheet 13 sent from sheet cassette 15 by one rotation of the separation roller 17 is fed along the paper feeding path 35 toward the resist rollers 41 by the paper supplying roller 19. At this time, CPU 51 judges whether the sensor 42 has output a signal or not (S6). When CPU 51 determines that the sensor 42 has not output the signal (S6:No), CPU 51 repeats the S6. When the sheet 13 is fed and the front edge of the sheet 13 moves the actuator 42A from the first position to the second position, the sensor 42 outputs a signal to CPU 51 which shows that the sheet 13 has curved near the resist rollers 42. When CPU 51 receives the signal output from the sensor 42 (S6:Yes), CPU 51 makes the timer 51A start to count a time again (S7). CPU 51 reads out the second time stored in ROM 53, and judges whether the timer 51A has counted the second time or not (S8). When CPU 51 determines that the timer 51A has not counted the second time (S8:No), CPU 51 repeats the S8. At this time, feeding of the sheet 13 continues, and the front edge of the sheet 13 is bumped against the resist rollers 41 at a stop state.

Then, the neighboring part of the rear end of the sheet 13 comes in contact with the projection part 38 of the sheet guide 37A. However, as the sheet 13 continues being fed by the paper supplying rollers 19, the sheet 13 is bent in the curve part 39 between the resist rollers 41 and the projection part 38 as shown in FIG. 2 with a dashed line. Because of this bending of the sheet 13, the front edge of the sheet 13 strongly contacts resist rollers 41, and the inclination and the position of the sheet 13 are corrected. The second time is set longer than a time which is necessary for the correction of the inclination and position of the sheet 13. When CPU 51 determines that the timer 51A has counted the second time (S8:Yes), CPU 51 makes the second electromagnetic clutch 67 connect, and the rotational power of the motor 63 is transmitted to the resist rollers 41 (S9). When resist rollers 41 are caused to rotate by the motor 63, the sheet 31 is fed toward print part 21. At this time, CPU 51 makes the timer 51A keep counting the time without initialization. Further, CPU 51 reads out the third time stored in ROM 53 and judges whether the timer 51A has counted the third time or not (S10). When CPU 51 determines that the timer 51A has not counted the third time (S10:NO), CPU 51 repeats the S10. When CPU 51 determines that the timer 51A has counted the third time (S10:YES), CPU 51 makes the second electromagnetic clutch 67 disassociate (S11) and stops the rotation of the resist rollers 41. As the third time is set longer than the time from when the front edge of the sheet 13 is sensed by the sensor 42 to when the rear end of sheet 13 is separated from the resist rollers 41, the rear end of the sheet 13 has already arrived at the print part 21 when resist rollers 41 stop. The sheet 13 is fed to the transferring position between transferring roller 25 and transferring portion 27 in print part 21 by resist rollers 41.

On the other hand, the laser beam based on the dot pattern of one page stored in the page buffer of RAM 55 is emitted to the transferring roller 25 from the laser unit 22, and the latent image is formed on the transferring roller 25. Then, the toner particles are supplied from the well-known toner particle supply portion to this latent image, and the toner image is formed on the transferring roller 25. This toner image is transferred onto the sheet 13 which has been fed to the transferring position in transferring portion 27. The sheet 13 on which the toner image is transferred is further fed along the sheet guide 47, and goes into the thermal fixing part 29. The sheet 13 is heated in the thermal fixing part 29 and the toner image is fixed on the sheet 13. The sheet 13 on which the toner image is fixed is further fed along the sheet guide 48, and discharged through the sheet outlet 11A on the discharging tray 31 by the discharging rollers 33.

As described above in detail, the laser printer 1 of the present invention has a curve part 38 in which the sheet 13 is stored in a vertical part of paper feeding path 35. Thus, it is possible to enlarge the toner cartridge or to miniaturize the entire printer. Moreover, the inclination and the position of the sheet 13 can be corrected and sheet 13 can be accurately fed between the transferring roller 25 and transferring portion 27 in print part 21.

The invention is not limited to the above-mentioned embodiment. The present invention can be changed and modified without departing from the scope of the invention.

For instance, a counter may be used in this invention instead of the timer 51A built in CPU 51. Moreover, the sheet feeding device of this embodiment can be applied to other image forming devices such as an ink jet printer, a dot printer, a thermal transfer printer and a copier.

What is claimed is:

1. A sheet feeding device provided in an image recording apparatus having print means which is capable of printing an image on a sheet, comprising:

sheet supplying means for supplying a sheet, said sheet supplying means being provided substantially beneath said print means;

feeding means for feeding the sheet supplied from said sheet supplying means to said print means;

guide means for cooperating with said sheet supplying means and for guiding the sheet to said feeding means;

buffer means for storing a part of the sheet, said part of the sheet being a bent sheet part, said buffer means being provided in a portion of said guide means that is substantially perpendicular to a horizontal plane, said buffer means comprising a space formed by said guide means, said space having a narrow entrance portion and a middle portion according to a feeding direction of the sheet, said middle portion being wider than said entrance portion in the horizontal direction, said sheet supplying means feeding said sheet from a substantially horizontal position to said entrance portion of said buffer means, said sheet entering said entrance portion at a substantially vertical orientation, said narrow entrance portion being positioned adjacent said sheet supply means and so configured as to prevent bending of the sheet near the sheet supply means; and control means for driving said feeding means when a predetermined time has passed following driving of said sheet supplying means and for bumping the sheet against said feeding means.

2. The sheet feeding device according to claim 1, wherein said feeding means comprises a pair of resist rollers.

3. The sheet feeding device according to claim 1, wherein said guide means comprises a pair of sheet guides.

4. The sheet feeding device according to claim 3, wherein said buffer means is provided on one of said sheet guides and comprises a curve portion which projects in a direction primarily opposite to the other of said sheet guides.

5. The sheet feeding device according to claim 4, further comprising a projection portion which is provided on said one sheet guide and under said curve portion, said projection portion projecting in a direction toward said other sheet guide.

6. The sheet feeding device according to claim 1, further comprising detecting means outputting a signal which shows that a front edge of the sheet is fed to a position just prior to said feeding means.

7. The sheet feeding device according to claim 6, further comprising time count means, wherein said control means drives said time count means and counts a predetermined time when said control means receives the signal output from said detecting means, drives said feeding means and feeds the sheet to said print means after the predetermined time has passed.

8. The sheet feeding device according to claim 7, wherein said time count means sets said predetermined time to be longer than a time which is necessary for correction of sheet inclination and position after the sheet bumps against said feeding means and is bent.

9. An image recording apparatus, comprising:

storing means for storing accumulated sheets;

sheet supplying means for supplying a sheet from said storing means;

print means for printing an image on the sheet, said print means being provided substantially above said storing means;

feeding means for feeding the sheet supplied from said sheet supplying means to said print means;

guide means for cooperating with said sheet supplying means and guiding the sheet to said feeding means;

buffer means for storing a part of the sheet, said part of the sheet being a bent sheet part, said buffer means being provided in a portion of said guide means that is substantially perpendicular to a horizontal plane, said buffer means comprising a space formed by said guide means, said space having a narrow entrance portion and a middle portion according to a feeding direction of the sheet, said middle portion being wider than said entrance portion in the horizontal direction, said sheet supplying means feeding said sheet from a substantially horizontal position to said entrance portion of said buffer means, said sheet entering said entrance portion at a substantially vertical orientation said narrow entrance portion being positioned adjacent said sheet supply means and so configured as to prevent bending of the sheet near the sheet supply means; and control means for driving said feeding means when a predetermined time has passed following driving of said sheet supplying means and for bumping the sheet against said feeding means.

10. The image recording apparatus according to claim 9, wherein said feeding means comprises a pair of resist rollers.

11. The image recording apparatus according to claim 9, wherein said guide means comprises a pair of sheet guides.

12. The image recording apparatus according to claim 11, wherein said buffer means is provided on one of said sheet guides and comprises a curve portion which projects in a direction primarily opposite to said other sheet guide.

13. The image recording apparatus according to claim 12, further comprising a projection portion which is provided on said one sheet guide and under said curve portion, said projection portion projecting in a direction toward said other sheet guide.

14. The image recording apparatus according to claim 9, wherein said sheet supplying means comprises:

a separation roller separating an uppermost sheet of accumulated sheets stored in said storing means and feeding the separated sheet out of said storing means, said separation roller having a "D-like" sectional shape; and a pair of sheet feeding rollers feeding the sheet fed from said storing means by said separation roller to said feeding means.

15. The image recording apparatus according to claim 14, further comprising time count means, wherein said control means drives said separation roller and drives said time count means when an image data is input from an external device, and said control means stops driving the separation roller when a first predetermined time has passed.

16. The image recording apparatus according to claim 15, wherein said first predetermined time is a time required for one rotation of the separation roller, said control means stopping driving the separation roller after said time required for one separation roller rotation.

17. The image recording apparatus according to claim 16, further comprising detecting means outputting a signal indicating that a front edge of the sheet is fed to a position just prior to said feeding means.

18. The image recording apparatus according to claim 17, wherein said control means drives said time count means and counts a second time when said control means receives the signal output from said detecting means, drives said feeding means and feeds the sheet to said print means after the second time has passed.

19. The image recording apparatus according to claim 18, wherein said control means counts said second time such that said second time is longer than a time which is necessary for correction of sheet inclination and position after the sheet is bumped against said feeding means and is bent.

20. A sheet feeding device provided in an image recording apparatus having print means which is capable of printing an image on a sheet, comprising:

sheet supplying means for supplying a sheet, said sheet supplying means being provided substantially beneath said print means;

feeding means for feeding the sheet supplied from said sheet supplying means to said print means;

guide means for cooperating with said sheet supplying means and for guiding the sheet to said feeding means;

buffer means for storing a part of the sheet, said part of the sheet being a bent sheet part, said buffer means being provided in a portion of said guide means that is substantially perpendicular to a horizontal plane, said buffer means comprising a space formed by said guide means, said space having a narrow entrance portion and a middle portion according to a feeding direction of the sheet, said middle portion being wider than said entrance portion in the horizontal direction, said sheet supplying means feeding said sheet from a substantially horizontal position to said entrance portion of said buffer means, said sheet entering said entrance portion at a substantially vertical orientation, wherein said narrow entrance portion of said guide means being formed in part by a projection portion of said guide means and said guide means at said narrow entrance portion said projection having a convex shape and extending into said guide means said entrance portion and said middle portion of said buffer means; and control means for driving said feeding means when a predetermined time has passed following driving of said sheet supplying means and for bumping the sheet against said feeding means.

* * * * *